US008196065B2

(12) United States Patent
Horiuchi et al.

(10) Patent No.: US 8,196,065 B2
(45) Date of Patent: Jun. 5, 2012

(54) REMOTE CONTROL UNIT OF AIR CONDITIONING APPARATUS

(75) Inventors: Kaya Horiuchi, Sakai (JP); Hisashi Sumida, Sakai (JP); Takashi Hasegawa, Sakai (JP); Kiyoshi Shima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 206 days.

(21) Appl. No.: 12/525,859

(22) PCT Filed: Feb. 13, 2008

(86) PCT No.: PCT/JP2008/052293

§ 371 (c)(1),
(2), (4) Date: Aug. 5, 2009

(87) PCT Pub. No.: WO2008/099824

PCT Pub. Date: Aug. 21, 2008

(65) Prior Publication Data

US 2010/0325580 A1 Dec. 23, 2010

(30) Foreign Application Priority Data

Feb. 13, 2007 (JP) ..... 2007-032729

(51) Int. Cl.
*G06F 13/00* (2006.01)
*G06F 15/00* (2006.01)

(52) U.S. Cl. ..... 715/858; 715/840

(58) Field of Classification Search ..... 715/700, 715/711, 740–745, 850–853, 805, 810, 819, 715/830, 829, 840, 858
See application file for complete search history.

(56) References Cited

U.S. PATENT DOCUMENTS

2004/0070491 A1 * 4/2004 Huang et al. ..... 340/10.5

FOREIGN PATENT DOCUMENTS

| | | | | |
|---|---|---|---|---|
| CN | 1604034 | A | | 4/2005 |
| JP | 06-026692 | A | | 2/1994 |
| JP | 08-076762 | A | | 3/1996 |
| JP | 2002-022250 | A | | 1/2002 |
| JP | 2003-035449 | A | | 2/2003 |
| JP | 2003035449 | A | * | 2/2003 |
| JP | 2003-195915 | A | | 7/2003 |

OTHER PUBLICATIONS

Office Action of corresponding Chinese Application No. 200880003080.9 dated Dec. 7, 2011.
Japanese Office Action of corresponding Japanese Application No. 2007-032729 dated Apr. 17, 2012.

* cited by examiner

*Primary Examiner* — Kevin Nguyen
(74) *Attorney, Agent, or Firm* — Global IP Counselors

(57) ABSTRACT

A remote control unit of an air conditioning apparatus includes a display unit, a cursor-moving member, a confirmation member, and a controller. The display unit displays a menu and a cursor that indicates an item among a plurality of items inside the menu and is moved by the cursor-moving member when operated by a user. The confirmation member is configured to decide that the item is to be executed. The controller controls the display unit in response to the cursor-moving member or confirmation member being operated, and stores screen display modes displayed on the display unit. Upon receiving a predetermined input from the confirmation member, the controller causes items allowing selection of the display modes to be displayed on the menu.

15 Claims, 6 Drawing Sheets

REMOTE CONTROL UNIT OF AIR CONDITIONING APPARATUS

CROSS-REFERENCE TO RELATED APPLICATIONS

This U.S. National stage application claims priority under 35 U.S.C. §119(*a*) to Japanese Patent Application No. 2007-032729, filed in Japan on Feb. 13, 2007, the entire contents of which are hereby incorporated herein by reference.

TECHNICAL FIELD

The present invention relates to a remote control unit for remotely operating an air conditioning apparatus.

BACKGROUND ART

An air conditioning apparatus is provided with a single remote control unit composed of a plurality of change switches, setting switches, selector switches, and a liquid-crystal display panel for displaying control specifics established by these switches (see Japanese Laid-open Patent Application No. 6-26692). With the remote control unit disclosed in Japanese Laid-open Patent Application No. 6-26692, it is standard to have one switch for each function. Accordingly, there is a tendency to add switches if functions are added, and a problem with greater complexity is encountered when the number of switches increases. A remote control unit comprising a menu selection confirm switch is disclosed as a technique for resolving this problem (Japanese Laid-open Patent Application No. 2002-22250). In the remote control unit disclosed in Japanese Laid-open Patent Application No. 2002-22250, a selector switch and a cursor button are placed on the menu selection confirm switch, a dot matrix display configuration is used in the liquid crystal display panel, the display specifics are not fixed as in conventional practice, and the display method can be set freely and easily varied. It is also possible to select the required function with the cursor button and the selection confirm switch while looking at the menu screen.

SUMMARY OF THE INVENTION (Technical Problem)

In the remote control unit according to Japanese Laid-open Patent Application No. 2002-22250, the number of switches is reduced and the complexity issue is resolved, yet the actual operation is not facilitated. Since functions are easily added, the number thereof tends to increase and the remote control unit can become more complicated to use.

An object of the present invention is to provide a remote control unit of an air conditioning apparatus which has excellent operability and is easily handled by a user.

(Solution to Problem)

A remote control unit according to a first aspect of the present invention is a remote control unit for remotely operating an air conditioning apparatus, comprising a display unit, cursor-moving means (cursor-moving button or member), confirmation means (confirmation button or member), and a controller. The display unit displays a menu and a cursor for indicating an arbitrary item inside the menu. The cursor-moving means moves the cursor. The confirmation means is used to decide that the item indicated by the cursor is to be executed. The controller controls object including the display unit to be controlled in response to the cursor-moving means or the confirmation means. The controller stores a plurality of screen display modes displayed on the display unit, and, upon receiving a first predetermined input, causes an item (a second item) for selecting the display modes to be displayed on the menu.

With this remote control unit, operability is further improved because the user can select the display mode that is easier to use.

A remote control unit according to a second aspect of the present invention is the remote control unit according to the first aspect of the present invention, wherein the first predetermined input is a single operation input made using the confirmation means.

With this remote control unit, operability is improved because the selected item can be searched for with a single operation.

A remote control unit according to a third aspect of the present invention is the remote control unit according to the first aspect of the present invention, wherein the display modes include at least a first display mode and a second display mode. The number of items displayed in the second display mode is greater than the number of items displayed in the first display mode.

With this remote control unit, even in cases of different numbers of items the user wishes to manage, usability is improved because the display mode can be selected according to the managed items.

A remote control unit according to a fourth aspect of the present invention is the remote control unit according to the first or second aspect of the present invention, wherein the display modes include at least a first display mode and a second display mode. A picture, letter, symbol, or numeral displayed in the second display mode differ in size and shape from the picture, letter, symbol, and numeral displayed in the first display mode.

With this remote control unit, the user can easily confirm the difference between the first display mode and the second display mode, and the user therefore can select the easier method of viewing.

A remote control unit according to a fifth aspect of the present invention is the remote control unit according to the third or fourth aspect of the present invention, wherein the screen outputted at least in either one of the first display mode and second display mode has a specified area in which the displayed items can be varied.

With this remote control unit, operability is improved because the user can select the settings in a simple manner when varying only some of the items.

A remote control unit according to a sixth aspect of the present invention is the remote control unit according to the fifth aspect of the present invention, wherein the controller causes items that can be displayed in the specified area to be displayed in the menu upon receiving a second predetermined input.

With this remote control unit, operability is improved because the user can select from a familiar menu.

A remote control unit according to a seventh aspect of the present invention is the remote control unit according to the sixth aspect of the present invention, wherein the second predetermined input is a single operation input made using the confirmation means in a state where the cursor has been moved to the specified area.

With this remote control unit, the process is ended with a single operation, and operability is improved.

(Advantageous Effects of the Invention)

With the remote control unit according to the first aspect of the present invention, operability is further improved because the user can select the display mode that is easier to use.

With the remote control unit according to the second aspect of the present invention, operability is improved because the selected item can be searched for with a single operation. With the remote control unit according to the third aspect of the present invention, even in cases of different numbers of items the user wishes to manage, usability is improved because the display mode can be selected according to the managed items.

With the remote control unit according to the fourth aspect of the present invention, the user can easily confirm the difference between the first display mode and the second display mode, and the user therefore can select the easier display mode of viewing.

With the remote control unit according to the fifth aspect of the present invention, operability is improved because the user can select the settings in a simple manner when varying only some of the items.

With the remote control unit according to the sixth aspect of the present invention, operability is improved because the user can select from a familiar menu.

With the remote control unit according to the seventh aspect of the present invention, the process is ended with a single operation, and operability is improved.

DETAILED DESCRIPTION OF THE INVENTION

An embodiment of the present invention is described hereinbelow with reference to the drawings. The following embodiment is a specific example of the present invention and is not intended to limit the technological scope of the invention.

(General Configuration of Air Conditioning Apparatus)

Figure 1:
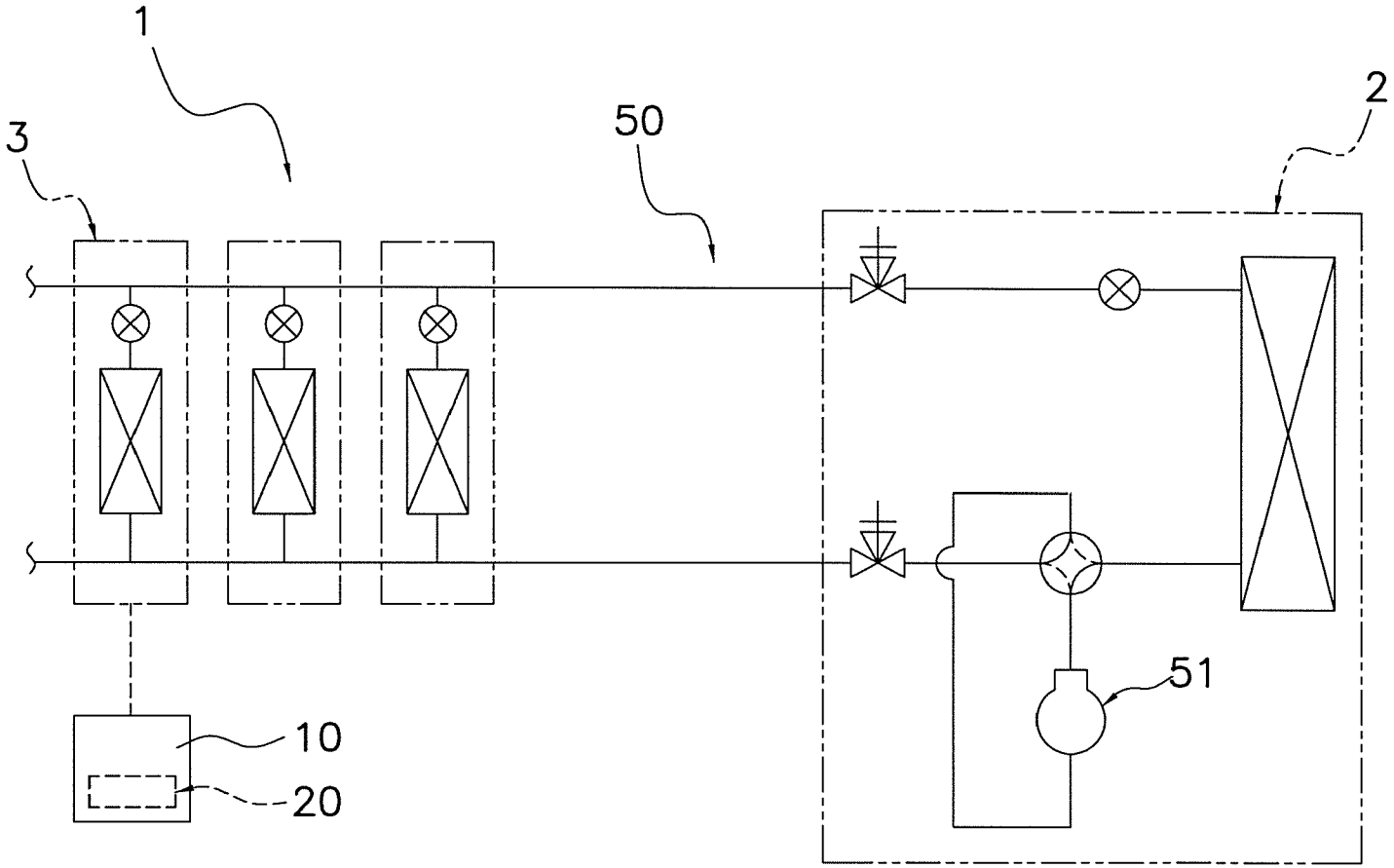
FIG. 1 is a schematic structural drawing of an air conditioning apparatus including a remote control unit according to an embodiment of the present invention.

FIG. 1 is a schematic structural drawing of an air conditioning apparatus including a remote control unit according to an embodiment of the present invention. An air conditioning apparatus 1 is a multi-type air conditioning apparatus for a building, wherein a plurality of indoor units 3 are connected in parallel with one or more outdoor units 2, and a refrigerant circuit 50 including a compressor 51 is formed so that refrigerant can flow through. A remote control unit 10 communicates with control devices (not shown) installed in both the outdoor unit 2 and indoor units 3 in accordance with operations made by the user so as to control the air conditioning apparatus 1.

(Remote Control Unit)

Figure 2:
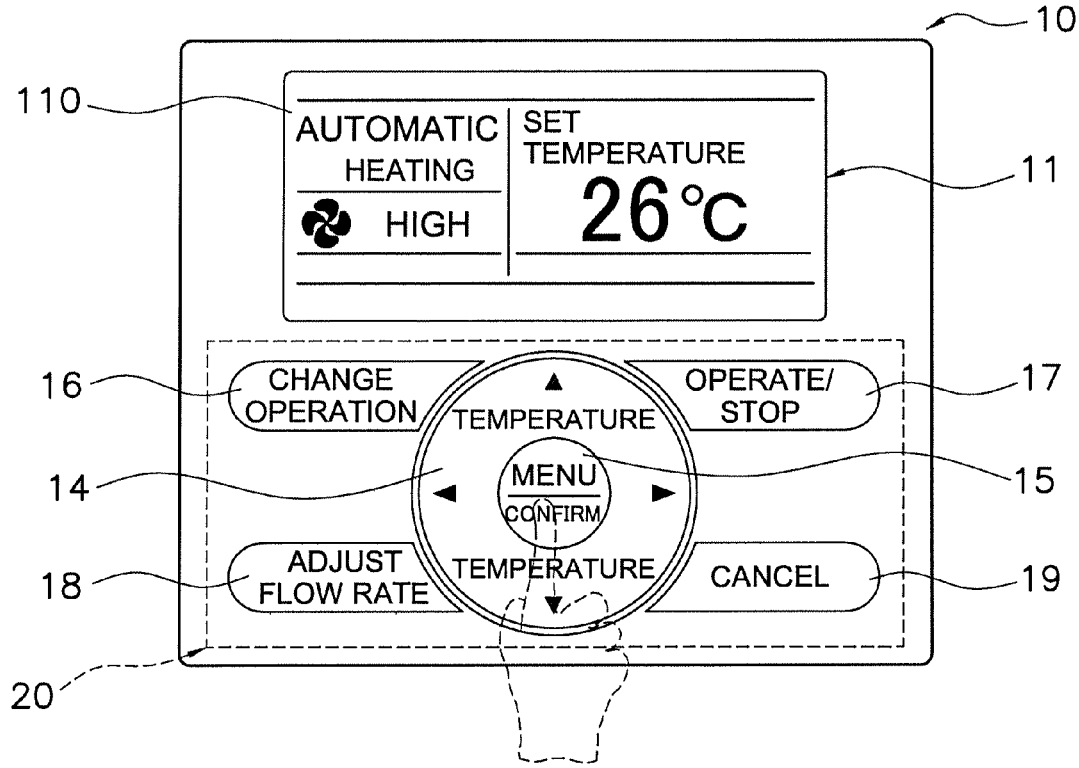
FIG. 2(*a*) is a front view showing standby mode of a remote control unit, and FIG. 2(*b*) is a front view of the remote control unit displaying a menu screen.
Figure 2:
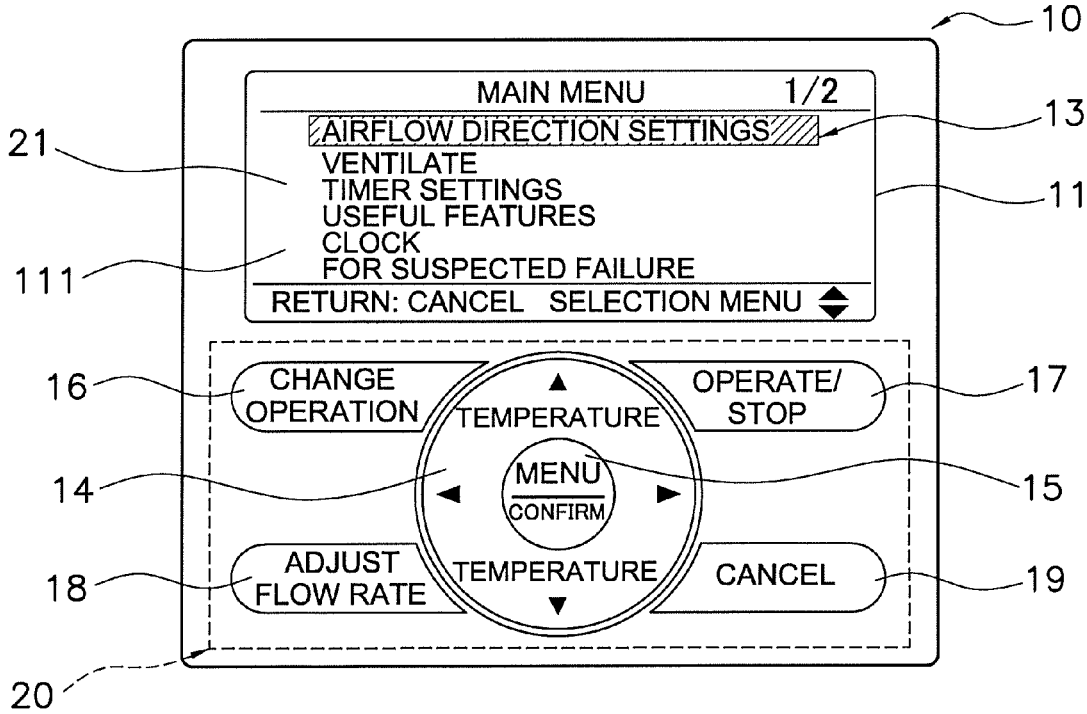

FIG. 2(*a*) is a front view showing standby mode of a remote control unit according to an embodiment of the present invention. In FIG. 2(*a*), the remote control unit 10 comprises a display unit 11, a cursor-moving button (cursor-moving member) 14, a confirm button (confirmation member) 15, a change operation button 16, an operate/stop button 17, an adjust flow rate button 18, a cancel button 19, and a controller 20.

The display unit 11 uses a full dot liquid crystal display, and can appropriately change displays between a standard screen 110 during standby mode, a menu screen 111 for displaying a menu 21, and the like. The cursor-moving button 14 is a button operated when moving a cursor 13 for indicating arbitrary items on the menu 21. The cursor-moving button 14 displays four marks showing the directions up, down, left, and right, and pressing a mark causes the cursor 13 to move in the direction corresponding to the mark.

The confirm button 15 is a button operated when deciding on an item on the menu 21 indicated by the cursor 13. The words "menu/confirm" are printed on the confirm button 15, and when the confirm button 15 is pressed, the menu 21 is displayed. When an item is selected from the menu 21 and the confirm button 15 is pressed again, the item is executed. Furthermore, the confirm button 15 is used not only to decide on items, but also to execute other controls. The time duration T for which the confirm button 15 is pressed is 1 second or less when deciding on an item, and 3 seconds or more when executing another control; however, the time duration T is not limited.

The change operation button 16 is a button operated when changing the operating mode of the air conditioning apparatus 1. Each time the change operation button 16 is pressed, the operating mode changes sequentially to blowing air, drying, automatic cooling, automatic heating, cooling, heating, air purification/ventilation, ventilation, and air purification. The operating mode while the apparatus is active is displayed at the top left of the standard screen 110 when viewed from the front. The operate/stop button 17 is a button operated when starting or stopping the operation of the air conditioning apparatus 1, and the operate/stop button 17 repeats starting and stopping each time it is pressed.

The adjust flow rate button 18 is a button operated when adjusting the amount of air discharged from the indoor units 3. Each time the adjust flow rate button 18 is pressed, the flow rate changes sequentially between low, high, and rapid. The cancel button 19 is a button operated when cancelling out the specifics set with the confirm button 15 or another button.

The controller 20 has a microcomputer (not shown) and a memory (not shown). The controller 20 reacts to the operations of the cursor-moving button 14, the confirm button 15, the change operation button 16, the operate/stop button 17, the adjust flow rate button 18, and the cancel button 19, and communicates with the display unit 11, the control device (not shown) of the outdoor unit 2, and the control devices (not shown) of the indoor units 3 so as to set the air conditioning apparatus 1 to the appropriate operating state. The controller 20 is located inside the remote control unit 10 and therefore cannot be seen from the outside.

The controller 20 keeps the display unit 11 in standby in the standard screen 110 when the controller 20 has not received any input. In the standard screen 110, the operating mode is displayed in the top left section, the flow rate is displayed in the bottom left section, and the set temperature is displayed in the right section, as shown in FIG. 2(*a*). When varying the set temperature, pressing the top of the cursor-moving button 14 raises the numeral, and pressing the bottom of the cursor-moving button 14 lowers the numeral.

When the display unit 11 is in standby in the standard screen 110, pressing the confirm button 15 once changes to a menu screen displaying the menu 21. FIG. 2(*b*) is a front view of the remote control unit displaying a menu screen. In FIG. 2(*b*), the menu 21 includes an "airflow direction setting" item for setting the direction of discharged air, a "timer setting" item for setting the operation starting time or operation stopping time, and other items.

When the user selects an item from the menu 21, the cursor 13 is moved to the desired item with the cursor-moving button 14, and pressing the confirm button 15 once while the item is indicated by the cursor 13 causes specifics pertaining to the item to be displayed.

(Message Display when a Fault Occurs)

Figure 3:
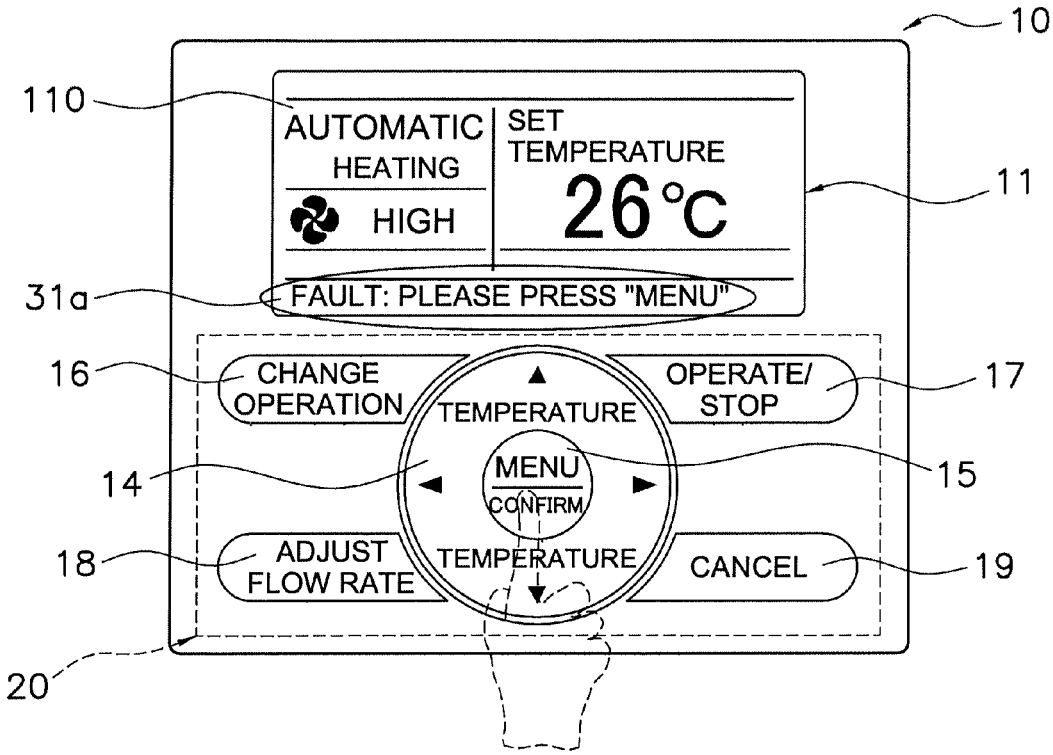
FIG. 3(*a*) is a front view of the remote control unit displaying a message, FIG. 3(*b*) is a front view of the menu screen after the notification of a fault message, and FIG. 3(*c*) is a front view of a fault response screen.
Figure 3:
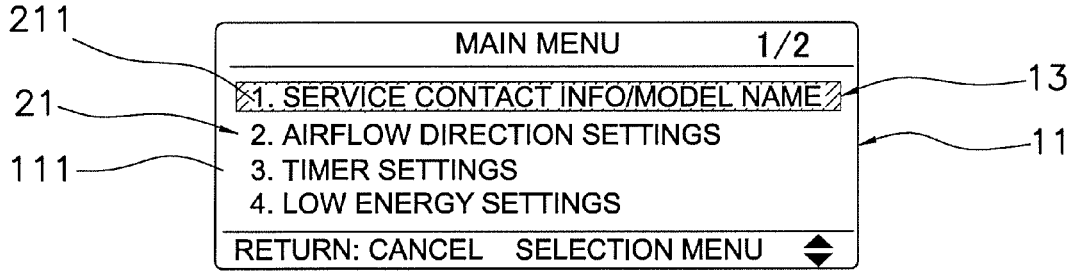
Figure 3:
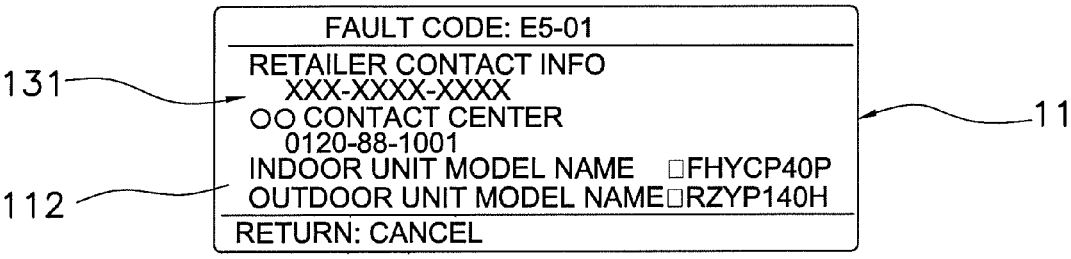

The remote control unit 10 displays a message on the display unit when a fault has occurred in the air conditioning apparatus 1. FIG. 3(*a*) is a front view of the remote control unit displaying a message. In FIG. 3(*a*), a message display column is set in the bottom section of the standard screen 110. Usually, nothing is displayed in the message display column, but when the controller 20 has received a fault occurrence notification signal input from the air conditioning apparatus 1 notifying that a fault has occurred, a fault message 31*a* reading "fault: please press menu" is displayed in the message display column. As a result, the user detects that a fault has occurred in the air conditioning apparatus 1 and presses the confirm button 15 where "menu" is printed.

When the confirm button 15 is pressed after the fault message 31*a* is displayed, the controller 20 changes the display unit 11 to the menu screen 111, and the menu 21 is displayed. FIG. 3(*b*) is a front view of the menu screen after the notification of the fault message. In FIG. 3(*b*), a fault response item 211 reading "service contact info/model name" is positioned at the head of the menu 21.

When the controller 20 receives an operation input from the confirm button 15 after receiving the fault occurrence notification signal input, the controller 20 places the fault response item 211 at the head of the menu 21 and moves the cursor 13 over the fault response item 211 so that the user can immediately find the fault response item 211. When the user presses the confirm button 15 again in this state, the display unit 11 changes to a fault response screen 112 for displaying fault response information 131. FIG. 3(*c*) is a front view of a fault response screen. In FIG. 3(*c*), the fault response information 131 includes contact information for use in the event of a fault, the model name of the air conditioning apparatus in which the fault occurred, and a fault code representing the specifics of the fault.

(Filter Cleaning Request Message)

Figure 4:
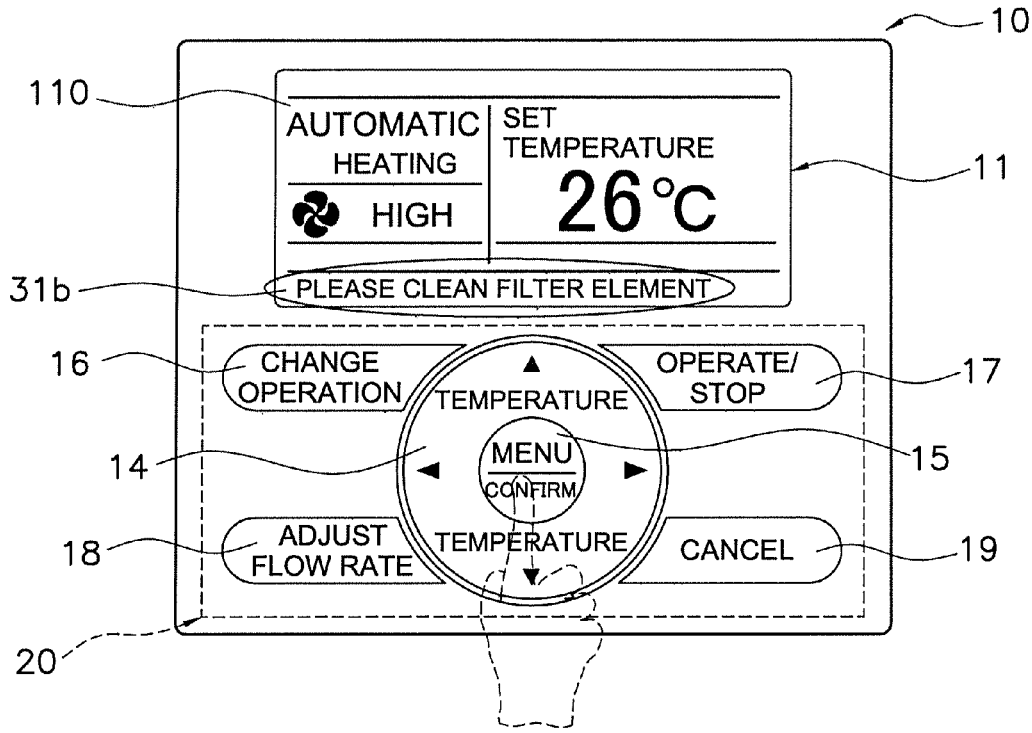
FIG. 4(*a*) is a front view of the remote control unit displaying a filter cleaning request message, and FIG. 4(*b*) is a front view of the remote control unit displaying the menu screen after the notification of the filter cleaning request message.
Figure 4:
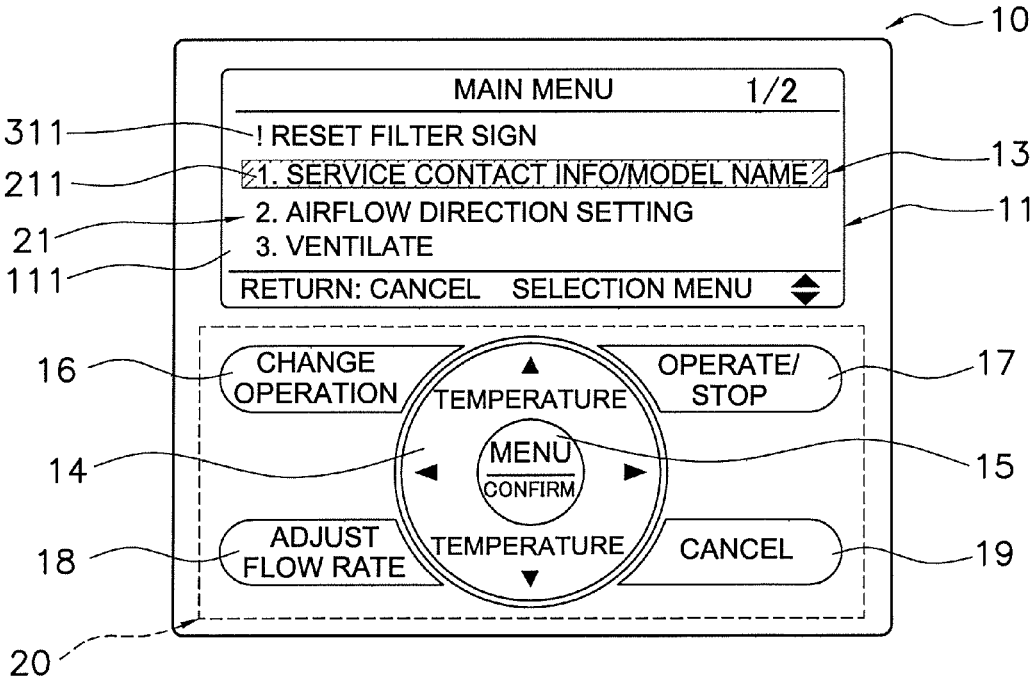

The messages are not limited to only times of faults in the air conditioning apparatus 1, and a message is also displayed when the filter becomes clogged. FIG. 4(*a*) is a front view of the remote control unit displaying a filter cleaning request message. When the controller 20 has received a filter maintenance request signal input from the air conditioning apparatus 1 notifying that the filter is clogged, a filter cleaning request message 31*b* reading "please clean the filter element" is displayed in the message display column. As a result, the user detects that the filter in the air conditioning apparatus 1 is clogged and presses the confirm button 15.

The controller 20 changes the display unit 11 to the menu screen 111 and displays the menu 21 when the confirm button 15 is pressed after the filter cleaning request message 31*b* is displayed. FIG. 4(*b*) is a front view of the remote control unit displaying the menu screen after the notification of the filter cleaning request message. In FIG. 4(*b*), a cancel command 311 reading "reset filter sign" and a fault response item 211 reading "service contact info/model name" are positioned at the top of the menu 21.

Since the air conditioning apparatus 1 can continue to operate even after the filter cleaning request message 31*b* has been displayed, the filter cleaning request message 31*b* remains continuously displayed. When the user wishes to delete the filter cleaning request message 31*b*, the user does so by selecting and executing the cancel command 311 reading "reset filter sign".

(Modifications)

In the embodiment described above, the display unit 11 was only capable of outputting one type of standard screen 110 during standby, but in the present modification, the mode of display in the standard screen 110 can be varied.

Figure 5:
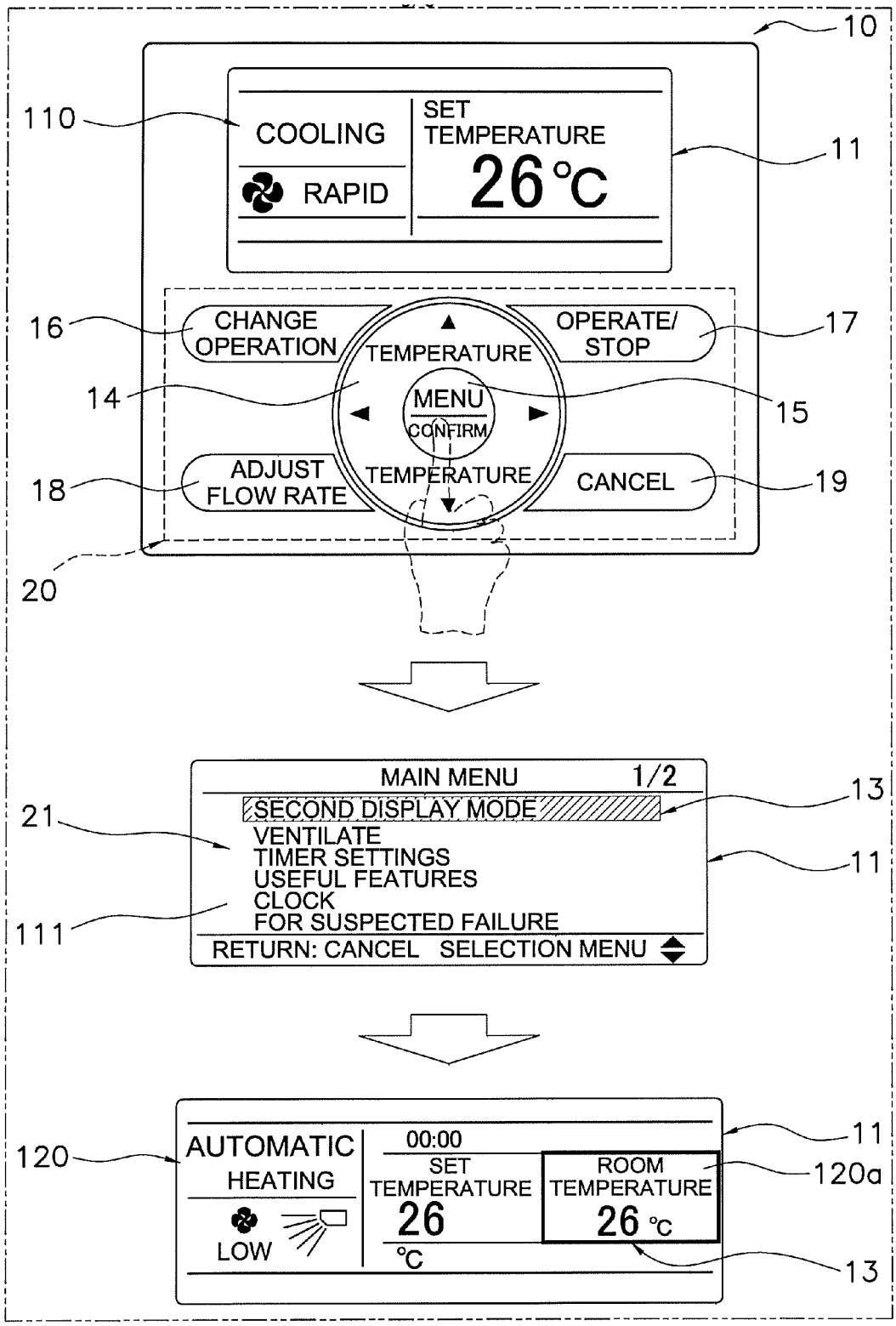
FIG. 5 is a front view of a remote control unit showing a process of varying the display mode of a standard screen.

FIG. 5 is a front view of a remote control unit showing the process of varying the display mode of the standard screen. In FIG. 5, when the user presses the confirm button 15 while the display unit 11 is in standby in the standard screen 110, the standard screen 110 changes to the menu screen 111. The menu 21 of the menu screen 111 contains the item "second display mode." The first display mode is the standard screen 110, and is removed from the menu 21 while in use. When the cursor 13 is moved to the item "second display mode" and the confirm button 15 is pressed, a second standard screen 120 of the second display mode is outputted to the display unit 11.

The standard screen 110 is provided with an operating mode display column, an airflow rate display column, and a set temperature display column. In the second standard screen 120, a room temperature display column is provided to the right of the set temperature display column, and an airflow direction display column is provided to the right side of the airflow rate display column. Due to the increase in display columns, the letters, numerals, symbols, and pictures of the display items are set to be smaller.

Figure 6:
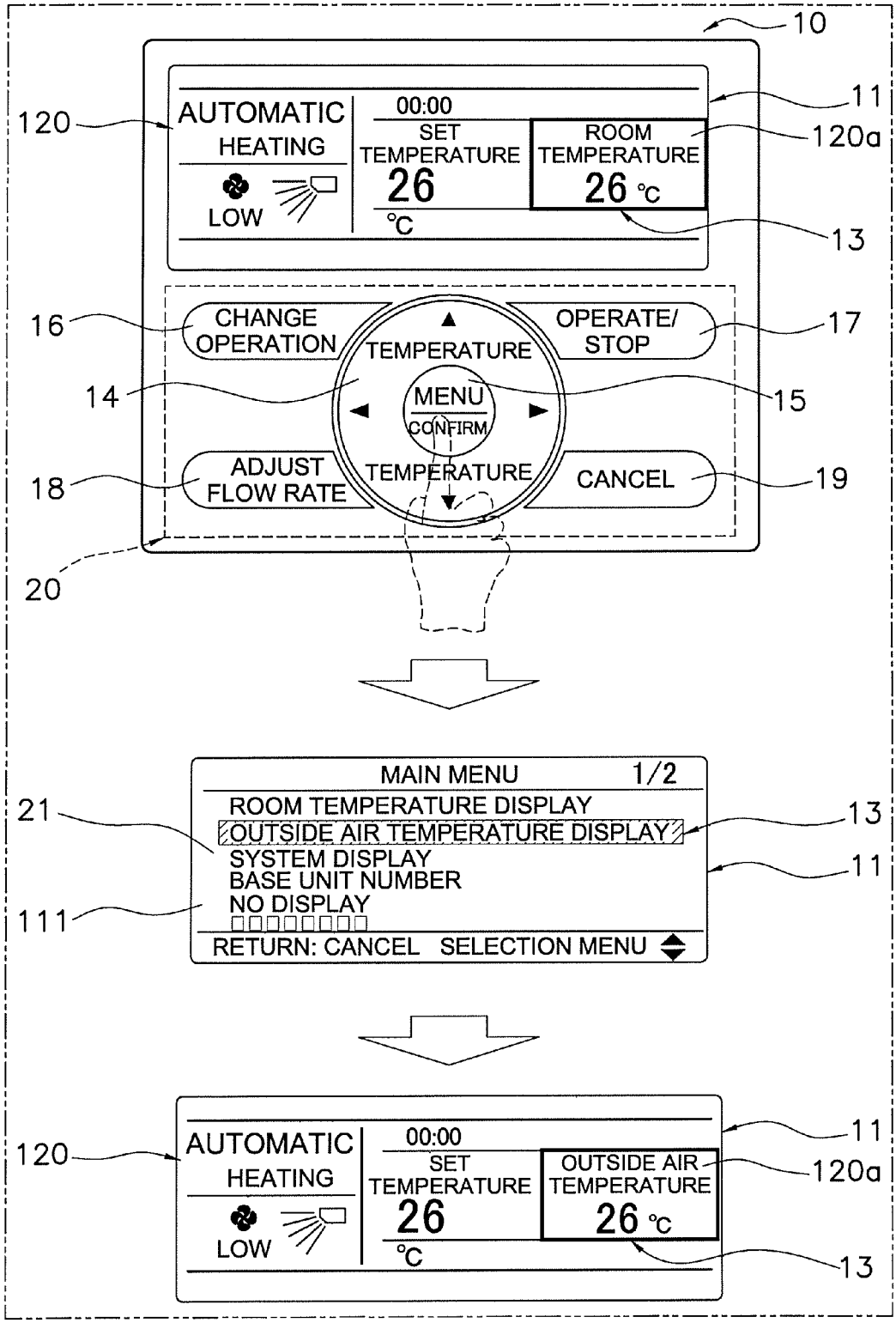
FIG. 6 is a front view of a remote control unit showing a process of varying the display items in a specified area of a second standard screen.

In the present modification, the room temperature display column is not fixed, but is a specified area 120*a* in which display items can be varied freely. FIG. 6 is a front view of a remote control unit showing the process of varying the display items in the specified area of the second standard screen. In FIG. 6, when the user moves the cursor 13 to the specified area 120*a* in which the room temperature is displayed and presses the confirm button 15 once, the screen changes to the menu screen 111. The menu 21 displays only the items that can be displayed in the specified area 120*a*. For example, when the user moves the cursor 13 to the item "outside air temperature display" and presses the confirm button 15 once, the outside air temperature is displayed in the specified area 120*a*.

(Characteristics)

(1)

In the remote control unit 10, the controller 20 stores the screen display modes displayed on the display unit 11, wherein the first display mode is the standard screen 110, and the second display mode is the second standard screen 120. Upon receiving one operation input from the confirm button 15, the controller 20 displays an item for selecting the display mode on the menu 21. Operability is further improved because the user can select a display mode which is easier to use. Operability is also improved because the selected item can be searched for with a single operation.

(2)

In the remote control unit 10, the number of items displayed in the second standard screen 120 of the second display mode is greater than the number of items displayed in the standard screen 110 of the first display mode. Even in cases of different numbers of items the user wishes to manage, usability is improved because the display mode can be selected according to the managed items. The pictures, letters, symbols, and numerals displayed in the standard screen 110 differ in size and shape from the pictures, letters, symbols, and numerals displayed in the second standard screen 120. The user can easily confirm the difference between the standard screen 110 and the second standard screen 120, and the user therefore can select the easier display mode of viewing.

(3)

In the remote control unit 10, the second standard screen 120 has a specified area 120*a* in which the displayed items can be varied. Operability is improved because the user can select the settings in a simple manner when varying only some of the items. When the controller 20 has received a single operation input from the confirm button 15 in a state in which the cursor 13 has been moved to the specified area 120*a*, the items that can be displayed in the specified area 120*a* are displayed in the menu 21. Operability is improved because the user can select from a familiar menu 21.

INDUSTRIAL APPLICABILITY

As described above, the remote control unit according to the present invention has a configuration which can be easily operated by a user, and therefore the remote control unit is useful as a remote control unit for a multifunctional air conditioning apparatus.

What is claimed is:

1. A remote control unit for remotely operating an air conditioning apparatus, the remote control unit comprising:

a display unit displaying a menu and a cursor indicating an item among a plurality of items inside the menu;

a cursor-moving member configured to move the cursor when operated by a user;

a confirmation member configured to decide that the item indicated by the cursor is to be executed; and a controller configured to control the display unit in response to the cursor-moving member or the confirmation member being operated, the controller being further configured to store a plurality of screen display modes displayed on the display unit, and to cause a second item allowing selection of the screen display modes to be displayed on the menu upon receiving a first predetermined input without the cursor-moving member being used.

2. The remote control unit according to claim 1, wherein the first predetermined input is a single operation input made using the confirmation member.

3. The remote control unit according to claim 2, wherein the plurality of display modes includes at least a first display mode and a second display mode, and a picture, letter, symbol, or numeral displayed in the second display mode differ in size and shape from a picture, letter, symbol, or numeral displayed in the first display mode.

4. The remote control unit according to claim 3, wherein a screen outputted in either one of the first display mode and the second display mode as a specified area in which the displayed items are configured to be varied.

5. The remote control unit according to claim 4, wherein the controller is further configured to cause items displayable in the specified area to be displayed in the menu upon receiving a second predetermined input.

6. The remote control unit according to claim 5, wherein the second predetermined input is a single operation input made using the confirmation member in a state where the cursor has been moved to the specified area.

7. The remote control unit according to claim 1, wherein the plurality of display modes includes at least a first display mode and a second display mode, and a number of items displayed in the second display mode is greater than a number of items displayed in the first display mode.

8. The remote control unit according to claim 7, wherein a screen outputted in either one of the first display mode and the second display mode has a specified area in which the displayed items are configured to be varied.

9. The remote control unit according to claim 8, wherein the controller is further configured to cause items displayable in the specified area to be displayed in the menu upon receiving a second predetermined input.

10. The remote control unit according to claim 9, wherein the second predetermined input is a single operation input made using the confirmation member in a state where the cursor has been moved to the specified area.

11. The remote control unit according to claim 1, wherein the plurality of display modes includes at least a first display mode and a. second display mode, and a number of items displayed in the second display mode is greater than a number of items displayed in the first display mode.

12. The remote control unit according to claim 11, wherein a screen outputted in either one of the first display mode and the second display mode has a specified area in which the displayed items are configured to be varied.

13. The remote control unit according to claim 12, wherein the controller is further configured to cause items displayable in the specified area to be displayed in the menu upon receiving a second predetermined input.

14. The remote control unit according to claim 13, wherein the second predetermined input is a single operation input made using the confirmation member in a state where the cursor has been moved to the specified area.

15. The remote control unit according to claim 1, wherein the plurality of display modes includes at least a first display mode and a second display mode, and the controller receives the first predetermined input while the display unit is in standby in the first display mode, and the display unit displays the menu containing a second item allowing selection of the second display modes.

* * * * *